United States Patent [19]

Puccinelli

[11] 4,077,668

[45] Mar. 7, 1978

[54] TWO PART PORTABLE CHAIR CONSTRUCTION

[76] Inventor: Jeffrey H. Puccinelli, Blagen Rd., Arnold, Calif. 95223

[21] Appl. No.: 749,927

[22] Filed: Dec. 13, 1976

[51] Int. Cl.[2] ..... A47C 4/00

[52] U.S. Cl. ..... 297/443; 297/18

[58] Field of Search ..... 297/18, 56, 443

[56] References Cited

U.S. PATENT DOCUMENTS

| | | | |
|---|---|---|---|
| 2,914,117 | 11/1959 | Underwood | 297/443 |
| 3,301,596 | 1/1967 | Eos | 297/443 |

FOREIGN PATENT DOCUMENTS

| | | | |
|---|---|---|---|
| 173,291 | 5/1952 | Austria | 297/30 |
| 1,460,084 | 10/1966 | France | 297/443 |
| 671,528 | 5/1952 | United Kingdom | 297/18 |

*Primary Examiner*—James C. Mitchell
*Attorney, Agent, or Firm*—David B. Harrison

[57] ABSTRACT

A chair construction of two separate yet complementary members. The first member includes two symmetrical, oppositely facing and substantially parallel side pieces held rigidly in relative position. A backrest may be provided by a first series of parallel and spaced apart slats which are secured rigidly and aligned transversely to even forward edges of the parallel side pieces of the first member. The first member also includes structure defining a gap below the backrest which has a vertical height generally the same as the depth of the side pieces. The gap is further defined by two transverse slats attached to rear edges of the side pieces. The second member includes two elongated side pieces which are substantially symmetrical with the side pieces of the first member and which are spaced apart for a distance sufficiently less than the side pieces of the first member so that the side pieces of the second member fit closely inside the side pieces of the first member. The side pieces of the second member are held rigidly in relative position by cross pieces which may also provide the seat element of the chair construction. Preferably, the seat element is provided by a second series of parallel, spaced apart slats which are aligned transversely and secured rigidly to the even upward edges of the side pieces of the second member along the front portion of the second member. Thus, the side pieces of the second member may slip through the gap of the first member to a position where the seat adjoins the back to provide the chair in its useful position. Alternatively, the second member may be slipped inside of the first member for storage and carrying purposes.

8 Claims, 7 Drawing Figures

TWO PART PORTABLE CHAIR CONSTRUCTION

BACKGROUND OF THE INVENTION

The present invention relates to chair constructions and more particularly the present invention relates to a two part portable chair construction of unjoined yet complementary parts.

Chairs constructed of natural and man-made materials have been known and used for centuries. Nevertheless, the chair art is constantly in the state of improvement and refinement. With a trend in modern living toward outdoor and indoor living, a need has arisen for chairs which are equally usable in the home and outside of the home, which are unusually rugged and durable yet attractive in appearance, and which may easily be placed in an essentially flat configuration for convenience of storage and carrying.

A number of collapsible chairs are known in the prior art. Those chairs were typically constructed of metal members and had multiple hinge and pivot points which enabled such chairs to be folded into relatively flat storage positions. While those chairs had been widely used and accepted, they had limitations. For example, such chairs were virtually worthless at the beach where their narrow legs sank into the sand or mud and where sand and other abrasive materials would become jammed in the interstices of the pivots and hinges with resulting abrasion and likely failure of the chairs. Also, such chairs were subject to corrosion at the beach from the effects of the salt air. Even in backyard use, the effects of the elements on such chairs were highly detrimental.

On the other hand, chairs made of wood and other natural materials which are capable of withstanding the elements have been in use long before chairs of metal. Nevertheless, wooden chairs incorporating wooden hinges and mechanisms enabling collapsing, have not been successful. Consequently, wooden chairs have had the manifest drawback of lack of collapsibility and easy storage. The fact that wooden chairs have not been collapsible has greatly impaired the portability thereof.

SUMMARY OF THE INVENTION

One object of the present invention is to provide an improved chair construction of two highly complementary parts: a back and a seat, which in assembly cooperatively provide the chair.

Another object of the present invention is to provide a two part chair construction in which one part may be nested within the other part for convenience of carrying and storage.

Yet another object of the present invention is to provide a two part chair construction wherein the nesting of one of the parts inside of the other part thereby provides a gripping handle for convenience of carrying.

A further object of the present invention is to provide a simple and rugged yet attractive chair construction preferably of natural material which is equally suited for use outdoors and indoors.

These and other objects and advantages are accomplished by the present invention which provides a chair construction of two separate yet complementary parts.

The first part includes two symmetrical, oppositely facing and substantially parallel side pieces held rigidly in relative position by cross bracing members. A backrest may be provided by a first series of parallel and spaced slightly apart slats which are secured rigidly and aligned transversely to even forward edges of the parallel side pieces of the first part. This first series of slats may provide in part the cross bracing members. The first part also includes structure defining a gap below the backrest which has a vertical height generally the same as the depth of the side pieces. The gap is defined at the back side of the first part by two transverse slats attached to aligned rear edges of the side pieces.

The second part includes two elongated side pieces which are substantially symmetrical with the side pieces of the first part and which are spaced apart for a distance sufficiently less than the side pieces of the first part to fit closely inside the side pieces of the first part. The side pieces of the second part are held rigidly in relative position by cross bracing members which may also provide the seat element of the chair construction. Preferably, the seat element may be a second series of parallel, spaced slightly apart slats which are aligned transversely and secured rigidly to the even upward edges of the side pieces of the second member along the front portion of the second member.

Thus, the side pieces of the second part may be slipped through the gap of the first part to a position where the seat adjoins the back to provide the chair in its useful position. Alternatively, the second part may be slipped substantially entirely inside of the first part for storage and carrying purposes.

DETAILED DESCRIPTION OF THE PREFERRED EMBODIMENT

Figures 1, 5:
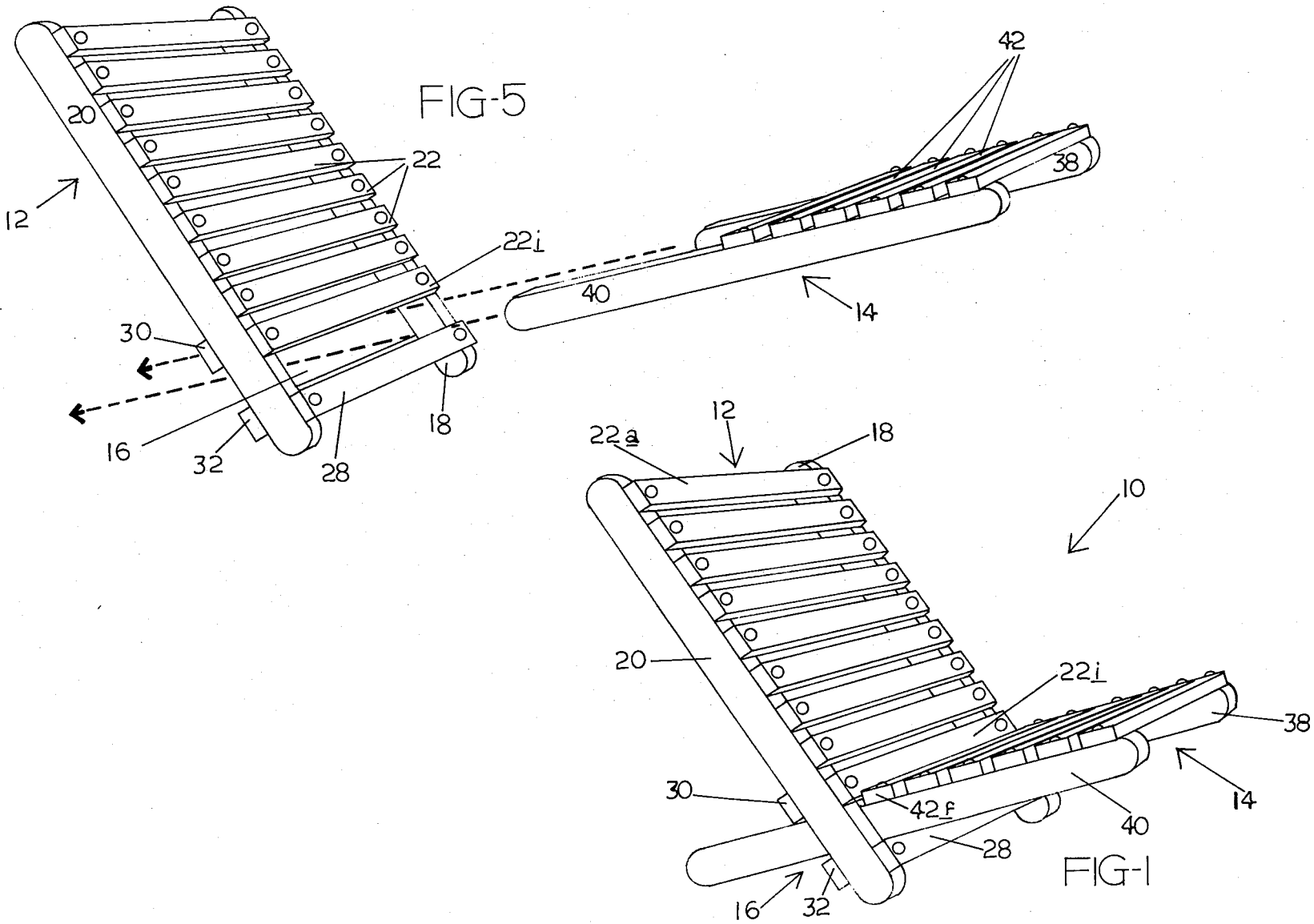
FIG. 1 is a perspective view of two part portable chair construction which incorporates the principles of the present invention; the construction is shown in its chair configuration.
FIG. 5 is a view in perspective of the parts of the chair construction of FIG. 1 showing the seat member aligned for insertion through the back member in the direction of the broken arrows.
Figure 6:
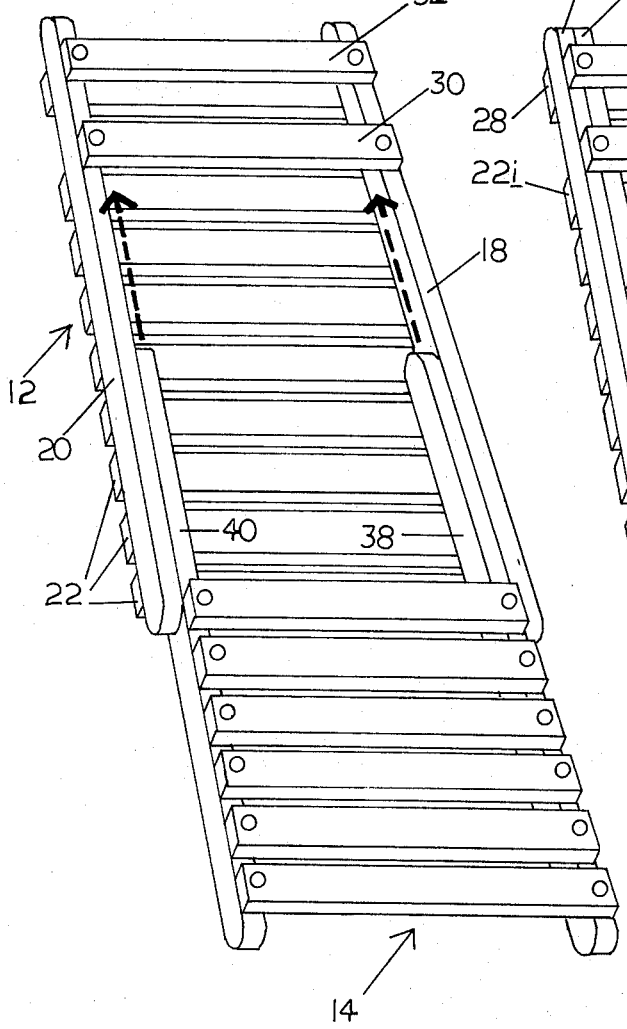
FIG. 6 is a perspective view of the parts of the chair construction of FIG. 1 showing the seat member placed partially inside of the back member and aligned for sliding in the direction of the broken arrows.
Figure 7:
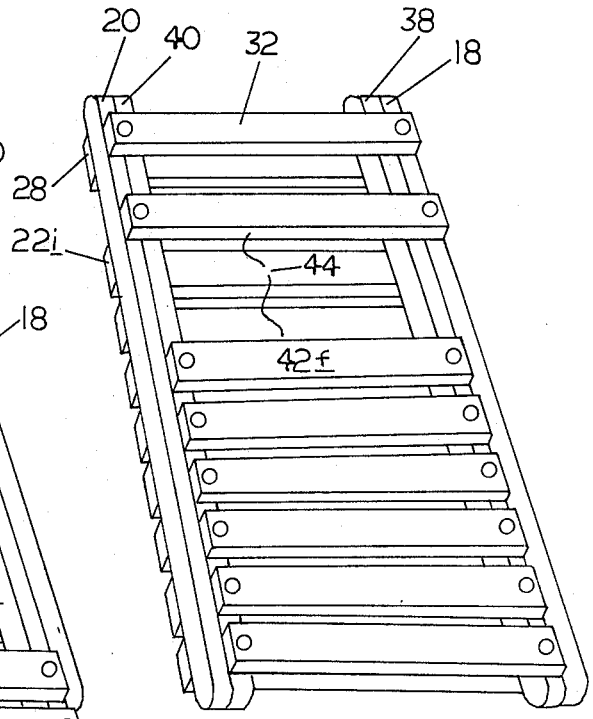
FIG. 7 is a perspective view of the chair construction of FIG. 6 showing the back member placed substantially entirely within a recess of the seat member; the construction is shown in its carrying and storage configuration.

A two part portable chair construction 10 is shown in its chair-providing configuration in FIG. 1. Therein, the chair 10 is seen to include a back part 12 and a seat part 14. As is perhaps best seen in FIG. 5, the seat part 14 slides through a suitable opening 16 in the back 12 so that the combination of the back part 12 and the seat part 14 cooperatively provides the chair. It is an important feature of the present invention that the seat part 14 is readily removable from the opening 16 so that the construction 10 may be collapsed for transportation or storage, as is shown in FIGS. 6 and 7 and as will be discussed in further detail hereinafter. The chair construction 10 is preferably made of wood, and may also be made of many different materials such as injection molded high density plastics, e.g., polyethylene, polystyrene, P.V.C., etc.

Figure 2:
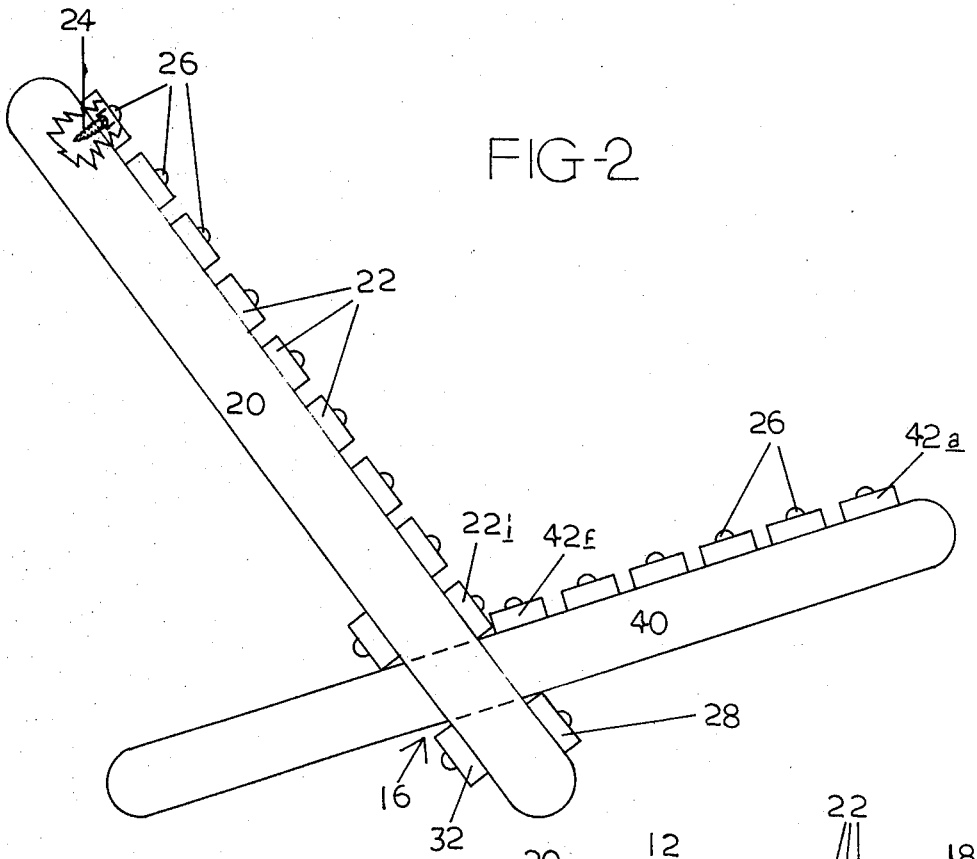
FIG. 2 is a view in side elevation of the assembled chair construction of FIG. 1, with hidden portions shown by broken lines, and a small portion cut away to show joinery by wood screws.
Figure 3:
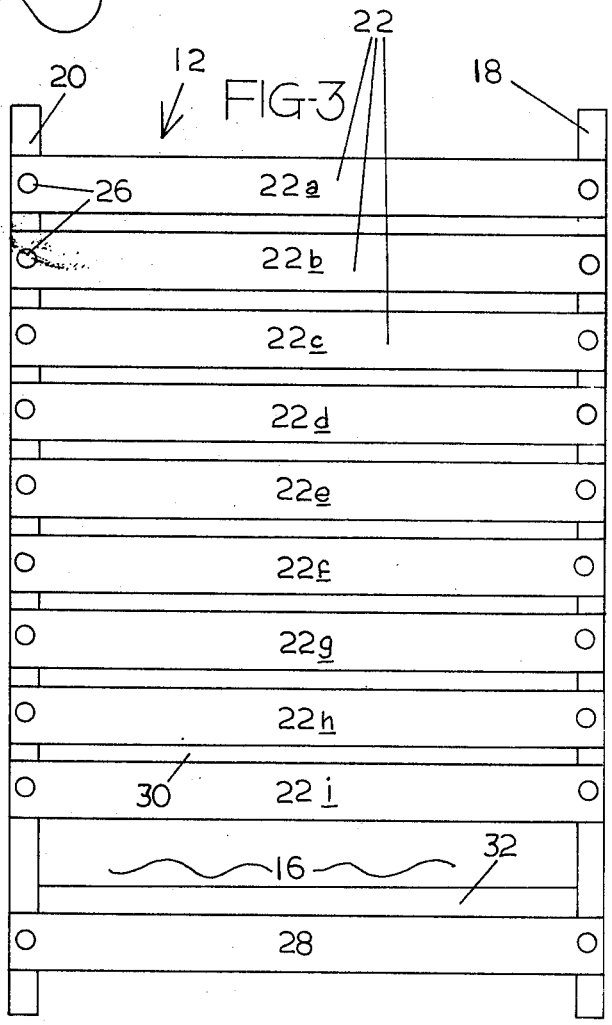
FIG. 3 is a view in front elevation of the separate backrest member of the chair construction of FIG. 1.

Referring now to FIGS. 2 and 3, the back part 12 of the chair construction 10 is seen to include two elongated side members 18 and 20 which are substantially symmetrical and which are placed slightly apart and rigidly held in relative position by a series 22 of slats. In the embodiment shown in the figures, there are nine such slats, *22a, 22b, 22c, 22d, 22e, 22f, 22g, 22h,* and *22i.* The slat *22a* is located at the top of the back portion 12 while the bottommost slat *22i* of the series 22 defines the upper horizontal edge of the opening 16 at the front of the back portion 12. The slats 22 are secured to front edge portions of the side members 18 and 20, preferably by gluing and by wood screws 24 (one wood screw is shown in place in the cut away portion of FIG. 2). The wood screws are preferably recessed and then covered by wooden plugs 26, so that the portrayal of wooden plugs 26 throughout the figures indicates the presence therebehind of a recessed wood screw 24. The rounded wooden plugs not only hide the wood screws from view, but provide an attractive embellishment to the appearance of the chair construction 10. Other forms of joinery would, of course, be entirely satisfactory, so long as each joint is made rigidly secure. Stapling through the slats with staples in combination with glue would work well.

Defining the lower horizontal edge of the opening 16 in the front of the back part 12, is a slat 28 which is secured to the front edges of the side members 18 and 20, e.g., by glue and wood screws 24. Additionally, there are two slats mounted to the back edges of the side members 18 and 20: a top rear slat 30 and a bottom rear slat 32. The slats 30 and 32 are likewise rigidly secured to the aligned back edges of the side members 18 and 20, e.g., by glue and wood screws 24. The top rear slat 30 and bottom rear slat 32 are offset vertically upward relative to the corresponding slats *22i* and 28 which define the opening 16. This offset enables the construction 10 to provide a chair wherein the back providing member 12 is at an obtuse angle relative to the seat providing member 14, as shown in FIG. 2 which provides a comfortable seating position to an occupant of the chair. If a different angle between the back 12 and the seat 14 were desired, such could easily be arranged by adjusting the offset of the rear slats 30 and 32 relative to the front slats *22i* and 28.

Figure 4:
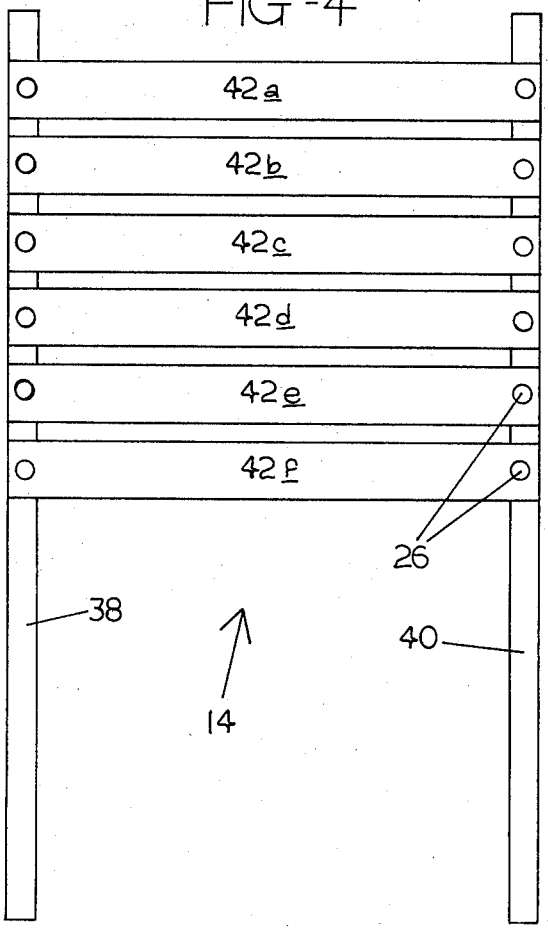
FIG. 4 is a view in front elevation of the separate seat member of the chair construction of FIG. 1.

Referring now to FIG. 4, the seat part 14 is quite like the back part 12. There are two side members 38 and 40 which are preferably symmetrical with the side members 18 and 20 respectively. The side members 38 and 40 are parallel to one another and are spaced apart for a distance which is less than the distance of spacing of the members 18 and 20 by an amount at least equal to the thickness thereof. Thus, the side members 38 and 40 are spaced apart so that they may slide freely yet snugly into the opening 16 in the back part 12 adjacently inside the side members 18 and 20 thereof. This sliding movement is suggested by FIG. 5 and produces the chair configuration shown in FIGS. 1 and 2. The seat part includes a second series of transversely aligned and slightly spaced apart slats 42 which are rigidly secured to upward aligned edges of the side members 38 and 40, by e.g., glue and screws 24 which are covered by the ornamental caps 26. In the embodiment of the seat part 14 shown in FIG. 4, there are six slats *42a, 42b, 42c, 42d, 42e* and *42f.* The series 42 is positioned on a forward portion of the seat part 14 and provides the cross structure which holds the side members 38 and 40 rigidly in relative position. The side members 38 and 40 thus project behind the series of slats 42 and provide the back legs of the chair configuration of the construction 10. The inner slat *42f* of the series 42 is seen to abut the lowermost slat *22i* of the series 22 of the back part 12 in FIG. 2 and thus, the slat *42f* functions as a stop which sets the limit of movement of the seat part 14 through the opening 16 of the back 12.

Referring now to FIGS. 5, 6, and 7, the construction 10 is seen to be easily reconfigured for storage and/or carrying. The seat part 14 is withdrawn from the opening 16 of the back part 12. The back part 12 is then placed on the floor, slats 22 downward. The seat part 14 is then placed with the side members 38 and 40 thereof inside and in axially alignment with the side members 18 and 20 of the back part 12, as shown in FIG. 6. Then, as shown in FIG. 7, the seat part 14 is pushed into a storage and carrying position which is substantially entirely within the back portion 20, so that the side members 38 and 40 of the seat part 14 are aligned with the corresponding side members 18 and 20 of the back part 12. An opening 44 between the top rear slat 30 and the innermost slat *42f* of the seat part 14 provides a convenient gripping location for gripping either pair of adjacent side members 18 and 38 or 20 and 40 by gripping one of the members 18 or 20 and the corresponding one of the other members 38 and 40. Not only is a convenient handle thereby provided, the seat part 14 is securely held by the user in place inside the side members 18 and 20 of the back part 12. For storage purposes, the gap provided between the members 30, 32 and the slat series 22 and the slat 28 of the back part holds the side members 38 and 40 of the seat part 14 in the storage and carrying configuration. In this configuration it will be appreciated that an additional storage area exists in the space between the back part 12 and the seat part 14. This space may be advantageously utilized to contain other collapsible furniture such as a small table or footrest.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A chair construction of two unjoined and complementary members wherein said members may be placed together in a first, chair providing configuration and may also be placed in a second, essentially flat storage and carrying configuration, said construction comprising:

a first member being of two symmetrical, oppositely facing and substantially parallel side pieces each having parallel major edges;

first cross brace means secured to said side pieces and extending transversely therebetween for holding said side pieces rigidly in relative position;

backrest means secured to said side pieces and extending therebetween in an upper portion of said first member for providing a backrest in said chair providing configuration;

said first cross brace means including a first transverse brace and a second transverse brace secured to front major edges of said side pieces, and third and fourth transverse braces secured to rear major edges of said side pieces thereby defining at least one gap through said first member below said backrest means and inside said parallel side pieces said gap lying between said first and second braces at said front edges and between said third and fourth braces at said rear edges;

said side pieces, said first cross brace means and said backrest providing means collectively defining a nesting recess in said first member, said recess being accessible at least at open upper and lower ends of said first member; and a second member being of two symmetrical, oppositely facing, and parallel sides, each having parallel major edges, each having a thickness between said major edges no greater than the thickness between said major edges of the side pieces of the first member and no greater than the height of the gap;

seat means secured to said sides and extending therebetween in a front portion of said second member for providing a seat for said construction in its chair providing configuration;

second cross brace means secured to said sides transversely therebetween for holding them rigidly in relative position, and for providing a stop adjacently behind said seat means;

said sides being spaced apart for a distance less than the distance between said side pieces so that said second member may slide into said recess provided in said first member to provide said construction in said essentially flat storage and carrying configuration and so that a rear portion of said second member may also slide through said gap until said stop is reached to provide said construction in said chair configuration.

2. The chair construction of claim 1 wherein said backrest means comprises a series of parallel, slightly spaced apart slats rigidly secured and transversely aligned along even forward edges of said side pieces.

3. The chair construction of claim 1 wherein a series of parallel, slightly spaced apart slats secured transversely along even upward edges of said front portion thereof provide said seat means and said second cross brace means.

4. The chair construction of claim 1 further comprising gripping handle means for enabling gripping and carrying said construction when positioned in said second configuration.

5. The chair construction of claim 1 made substantially out of wood.

6. A chair construction of two separate yet cooperating structural elements comprising:

a first element including:

first and second symmetrical elongated side members spaced apart and parallel and having substantially parallel forward and rear major edges, a first series of parallel, slightly spaced apart slats aligned transversely and secured rigidly, to said forward edges of said first and second side members along an upper portion thereof to provide a backrest;

a first single slat aligned transversely and secured rigidly to said forward edges of said first and second members at a location spaced away from the lowermost slat of said first series to define thereby a transverse gap therebetween of a dimension generally corresponding to the distance across said first and second members from said forward to said rear edges thereof;

a second single slat secured transversely across even rear edges of said side members at a location defining the top boundary of said gap at the back of said first element;

a third single slat aligned transversely and secured rigidly across even rear edges of said side members at a location defining the bottom boundary of said gap at the back of said first element;

said side members, said first series of slats, and said first, second and third single slats collectively defining a recess in said first element, said recess being accessible at least at open upper and lower ends of said first element; and a second element including:

third and fourth elongated side members substantially symmetrical with said first and second side members, said third and fourth side members having substantially parallel forward and rear major edges and being spaced apart for a distance sufficiently less than said first and second members so that said third and fourth members fit closely inside said first and second members and are free to slide therebetween;

a second series of parallel, slightly spaced apart slats aligned transversely and secured rigidly to even upward edges of said third and fourth side members along a front portion of said second element to provide a seat;

whereby said second element may be slipped substantially entirely within said recess of said first element with the second series of slats adjacent and facing oppositely the first series of slats to place said chair construction in an essentially flat storage and carrying configuration and whereby a rear portion of said second element may be slipped through said gap to place said chair construction in an occupiable chair configuration wherein said second seat providing element is held rigidly at a predetermined angle relative to said first backrest providing element by interaction of said lowermost slat, said first slat, said second slat, and said third slat with respect to said third and fourth elongated side members.

7. The chair construction of claim 6 further including a gripping handle formed by a space between an inwardmost slat of said second series and said second single slat, when said construction essentially flat storage and carrying configuration.

8. The chair construction of claim 6 made substantially entirely out of wood.

* * * * *